US006308545B2

(12) United States Patent
Bürgel et al.

(10) Patent No.: US 6,308,545 B2
(45) **Date of Patent: *Oct. 30, 2001**

(54) METHOD AND APPARATUS FOR FORMING BLANKS

(75) Inventors: Lonka Bürgel, Schwarzenberg; Frank Schieck, Lauter, both of (DE)

(73) Assignee: Kuka Werkzeugbau Schwarzenberg GmbH, Schwarzenberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/472,192

(22) Filed: Dec. 27, 1999

(30) Foreign Application Priority Data

Dec. 31, 1998 (DE) ..... 198 60 851

(51) Int. Cl.[7] ..... B21D 26/02
(52) U.S. Cl. ..... 72/57; 72/63; 29/421.1

(58) Field of Search ..... 72/57, 61, 370.22, 72/63; 29/421.1

(56) References Cited

U.S. PATENT DOCUMENTS

| | | | | |
|---|---|---|---|---|
| 2,997,093 | * | 8/1961 | Harris | 29/421.1 |
| 3,280,608 | * | 10/1966 | Parilla | 29/421.1 |
| 3,344,646 | * | 10/1967 | Moller | 72/63 |
| 3,827,130 | * | 8/1974 | Baumann | 29/421.1 |
| 5,524,466 | * | 6/1996 | Coe | 72/62 |
| 5,916,317 | * | 6/1999 | Willoughby et al. | 72/61 |

* cited by examiner

*Primary Examiner*—David Jones
(74) *Attorney, Agent, or Firm*—Lacasse & Associates; Randy W. Lacasse; Kevin E. Greene

(57) ABSTRACT

For shaping small radii in edge and corner regions of preformed workpieces or blanks, the invention provides for a postforming of exclusively said edge and corner regions by high liquid pressure. For performing the method an apparatus has a die part (forming insert) with expansion spaces constructed in its edge and corner regions.

15 Claims, 3 Drawing Sheets

METHOD AND APPARATUS FOR FORMING BLANKS

FIELD OF THE INVENTION

The invention relates to a method for forming blanks.

BACKGROUND OF THE INVENTION

If small radii are to be produced in edge and corner regions of workpieces by means of internal high pressure forming, i.e. forming by means of pressurizing the workpieces with a high liquid pressure in suitable forming dies, then for shaping these small radii extremely high pressures of about 4000 bar and higher are necessary. Thus, for keeping closed the die parts and/or a surrounding pressure casing, particularly in the case of large-surface area parts, very high keeping closed forces are necessary, which are difficult to achieve. This more particularly applies in conventional internal high pressure forming, in which the die simultaneously constitutes the pressure enclosure for the liquid bringing about forming. The invention more particularly relates to blanks preformed by means of internal high pressure forming and is in particular part of a corresponding method. However, it can also be used for otherwise preformed blanks.

Thus, the problem of the invention is to provide a method and an apparatus by means of which a postforming of blanks can take place in critical edge and corner regions.

SUMMARY OF THE INVENTION

According to the invention, the set problem is solved in the case of a method of the aforementioned type in that a postforming of preformed blanks exclusively takes place by means of high liquid pressure in the edge and corner regions. An apparatus for forming blanks for solving the set problem is characterized by a forming die with concave expansion spaces in its edge and corner regions.

According to a preferred development of the inventive method, only expansion spaces formed at edge and corner regions of a forming die part are subject to a high liquid pressure and in particular in recessed edge and corner regions of a forming die part (forming insert) closed expansion elements engaging in regions of the blank to be formed are subject to high liquid pressure. The expansion spaces of the corresponding die part, which can be a forming insert, but also an upper or lower part of a die, provided that thereon by convex cavity blocks can be constructed concave areas of the workpiece or blank facing the same, are directly exposed to the high liquid pressure. As a result of the tight engagement of a die part enclosing the workpiece or blank within it and e.g. a forming insert in planar areas or regions with large radii, at least if no small radii have to be formed in marginal areas of the workpiece up to the closing edges of the die parts and particularly if the latter are surrounded by a separate pressure casing, it is possible to produce an adequate pressure drop. However, as stated, preferably there are separate expansion elements which, according to a preferred development, can comprise tubes and whose material is preferably polymer or elastically or plastically deformable metal and in the latter case the expansion elements are permanent elements.

As a result of the apparatus according to the invention, in edge or corner regions of a preformed workpiece or blank, local radii can be postformed under high liquid pressure. As a result of the small projection surface in the case of liquid pressurization solely in edge and corner regions and in which the transverse dimensions of the surfaces exposed thereto are only a few millimetres, it is possible to work with limited forces, particularly limited pressing and closing forces. Due to the fact that the expansion spaces to be filled with liquid under high pressure are very small compared with the spaces normally having to be filled in the case of internal high pressure forming, a rapid filling of said expansion spaces in the corner and edge regions is possible, so that short process times can be achieved for the postforming according to the invention.

The invention is more particularly usable with a die for internal high pressure forming with a spacer provided between the upper and lower part of the die, in which in at least one of said die parts is formed a workpiece and in which the liquid supply line for forming the workpiece takes place through the spacer, as described in the parallel patent application "Method and apparatus for the hydraulic forming of a workpiece" of the present applicant and whose content is made fully into part of the present disclosure. In this case the spacer is removed after preforming the workpiece and a forming insert constructed according to the invention is placed in the die and the die upper and lower parts from the first internal high pressure forming phase can be used without any change for postforming. The forming insert is a complete or partial form or shape memory of the sheet metal blank final geometry, which optionally has said expansion elements in the corner and edge regions to be postformed or calibrated. The expansion of the expansion elements is limited by the positive engagement of the insert, i.e. the walls of the insert bounding the expansion spaces receiving the expansion elements and serving as abutments.

BRIEF DESCRIPTION OF THE DRAWINGS

Further advantages and features of the invention can be gathered from the claims and following description of an embodiment of the invention with reference to the attached drawings, wherein show:

DETAILED DESCRIPTION RELATIVE TO THE DRAWINGS

Figure 1:
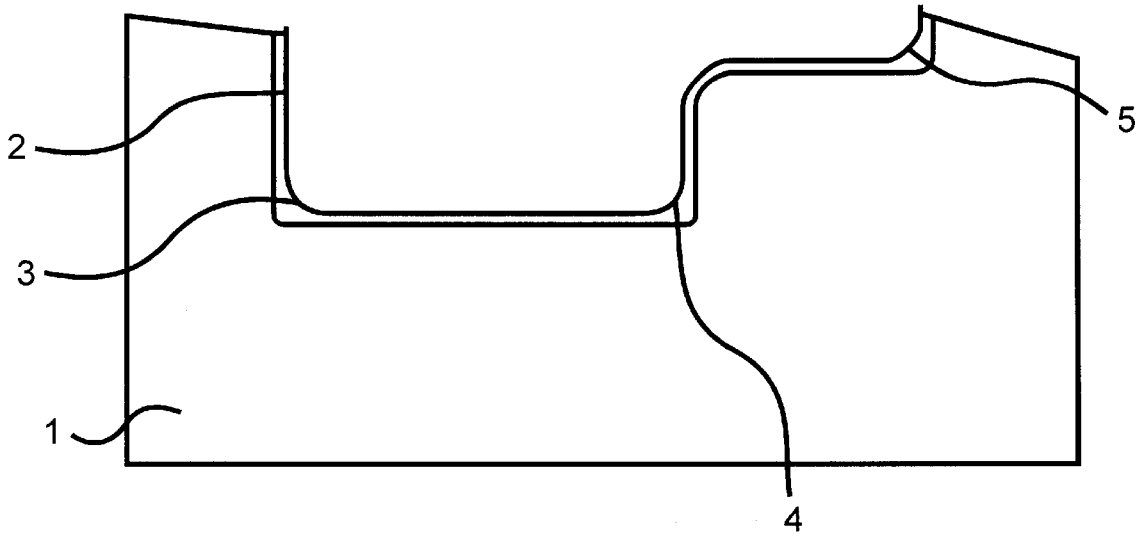
FIG. 1 A die lower part with a blank preformed therein.

FIG. 1 shows a lower part of a forming die for forming workpieces by means of high liquid pressure which has acted on the concave side of the workpiece 2 shown. The workpiece 2 can be constructed together with another workpiece having the same or a different design and forced into the cavity block of a die upper part, in which the high pressure is applied between the two workpieces, in accordance with DE 197 28 276 or DE 195 35 870, and between both workpieces, optionally a spacer can be provided, through which the filling pressure is passed. Alternatively the workpiece 2 can be formed alone and then a die upper part is required, but can have a random shaping. Preferably when working with high hydraulic pressure, forming takes place in a closed pressure casing separate from and surrounding the die. The invention now provides for the separate postforming of the in particular concave edges 3, 4, 5 of the workpiece 2. For this purpose an insert 6 is provided, which over most of its circumference engaging on the workpiece 2 follows the cavity block of the die part, in this case the lower part of the die, but the edge and corner regions 7 have concave expansion recesses 8 into which issue the pressure lines. In the embodiment shown in the drawings for this purpose there are expansion elements 9 closed in the expansion spaces 8 and which can e.g. comprise tubes, preferably of highly loadable, flexible, elastic polymer material. However, as a function of the complexity of the edges and the degree of forming required for the areas to be postformed, the expansion elements 9 can also be deformable metal tubes or pipes, which are shaped solely in their elasticity range, whereby the cross-sectional diameter of the expansion elements 9 can be small, or in the case of plastic deformation can also be permanent expansion elements.

The expansion elements 9 are connected to a liquid high pressure line leading in the die to the insert 8 and pressure is produced in the conventional manner for internal high pressure forming.

Figure 2:
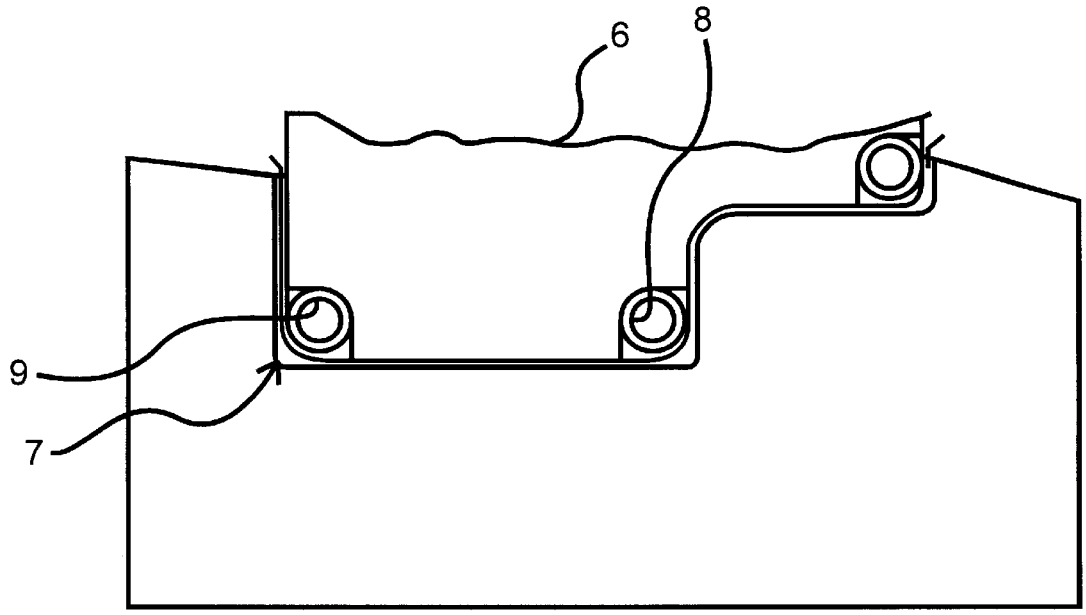
FIG. 2 The object of FIG. 1 with the preferred, inserted forming insert according to the invention.

If, as stated at the beginning of the description, the die lower part 1 is part of an internal high pressure forming die, following the preforming of the workpiece 2 by internal high pressure forming the die and optionally the surrounding, separate pressure casing is opened and if two workpieces are formed the upper blank is also raised. Then the forming insert 6 is inserted or swung in between the two blanks and consequently the two die parts, as shown in FIG. 2. Subsequently the die and an optionally surrounding pressure casing is closed again. Liquid is then introduced under high pressure into the expansion spaces 8 and more precisely in the represented embodiment into the expansion elements 9. The latter expand in their area not supported by the forming insert 6 against the edge regions 3, 4, 5 of the die 2 engaging thereon and press them into the edges and corners of the die part, in this case the lower part of the die 1. As a result the radii of curvature in the edge and corner regions of the workpiece 2, which according to FIG. 1 are initially relatively large, are significantly reduced and approach the radii of curvature of the die part in the edge and corner regions.

Following the postforming of the edges and corners 3 to 5 the die (optionally with the pressure casing) can be opened again and the finish-formed workpiece 2 can be removed from the die part (here the lower part).

Fundamentally the postforming of the edges and corners 3 to 5 of a preformed workpiece 2 can also take place in a postforming die, separate from the preforming die, with the die lower part 1 and forming insert 6. In this case in the empty die (die lower part 1) is inserted the preformed workpiece 1 and then the forming insert 6 is introduced. In this case a separate die upper part is not required and if working takes place with closed expansion elements 9, there is no need for a separate pressure casing.

Figure 3:
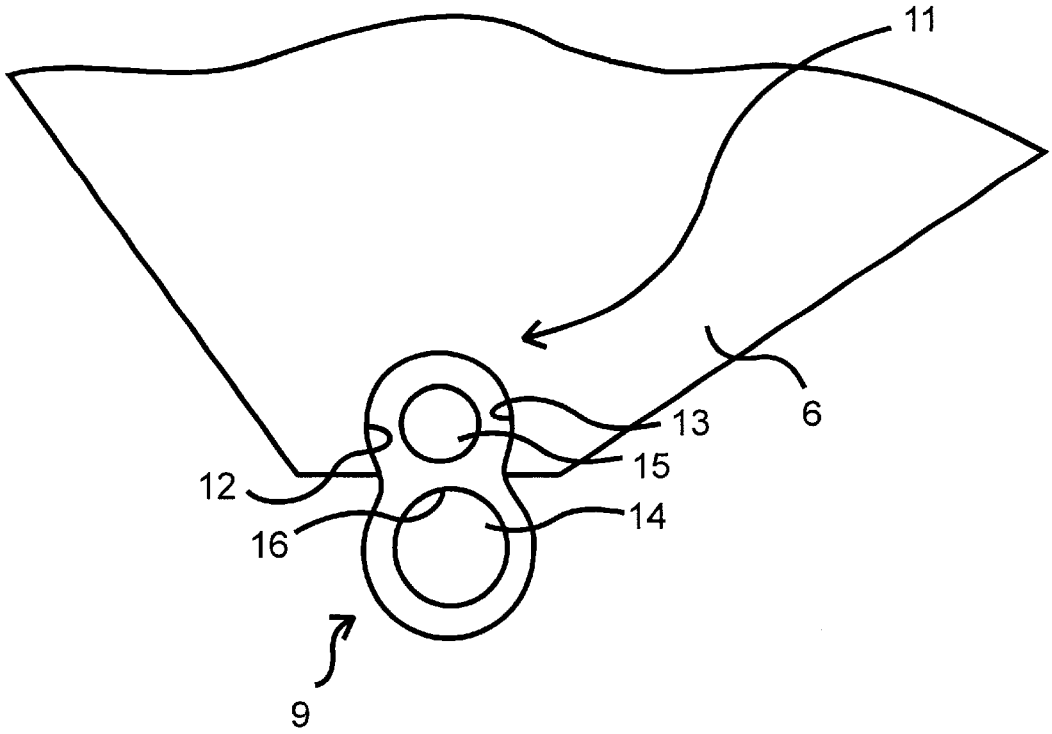
FIGS. 3 to 6 Detail representations for fixing expansion elements in a forming die.

Whereas in FIGS. 1 and 2 the fixing of the expansion elements 9 to the die part or forming insert is not shown in detail and the expansion elements can be inserted in the shown manner in the existing recesses of the forming insert 6, FIGS. 3 to 6 reveal measures for fixing the expansion elements to a die part or forming insert 6. In the case of FIG. 3 the forming insert 6 has a cross-sectionally pitch circular groove 11 with undercuts 12, 13, in which is inserted in form-closed manner the cross-sectionally 8-shaped expansion element with the upper part thereof (in the drawing). There are two pressurizable cavities 14, 15, which are separated by a web 16. The cavity 15 could be constructed with fully elastic material. Alternatively the web 16 can be omitted, so that the cavities 14, 15 pass into one another.

Figure 4:
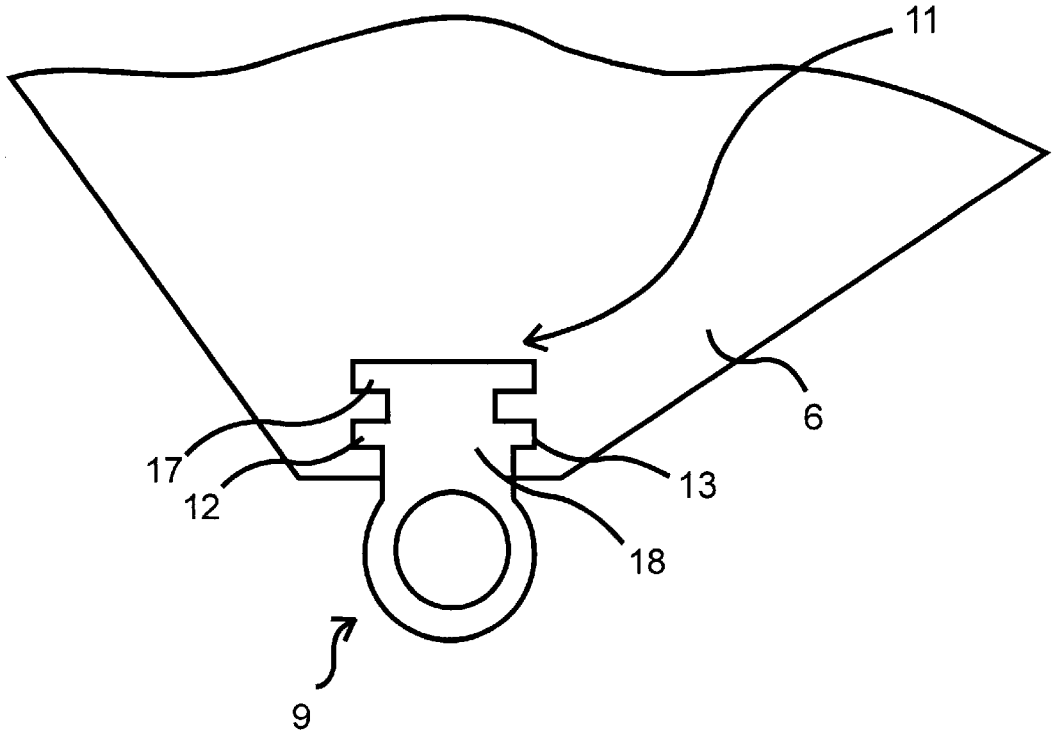

In the case of FIG. 4 for receiving part of the expansion element 9 there is also a groove 11 with undercuts 12, 13, into which engage in the insertion direction conically bevelled lugs 17 of a holding area of the expansion element 9 of the form-closed fixture.

Figure 5:
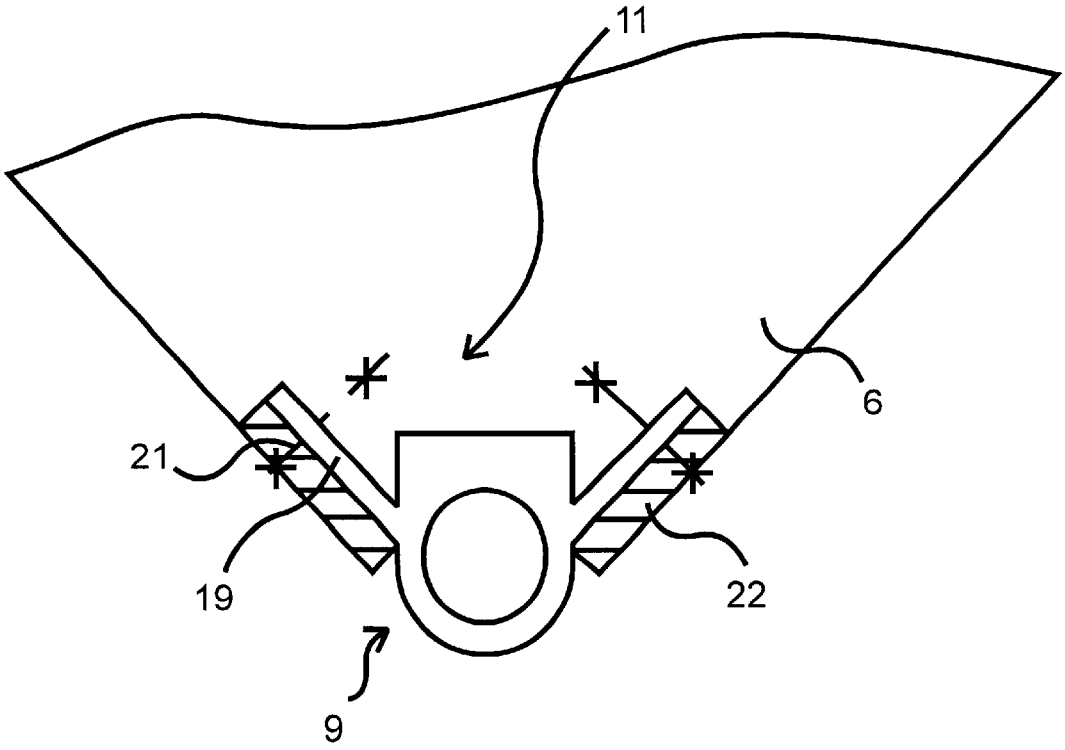

In FIG. 5 the expansion element 9 has lateral cover plates 19, which are covered by holding plates 22 fixed to the forming insert 6 by screws 21. Thus, through said holding plates and the screws 21 passing through the cover plates 19 there is a form-closed fixing of the expansion element 9 to the forming insert 6.

Figure 6:
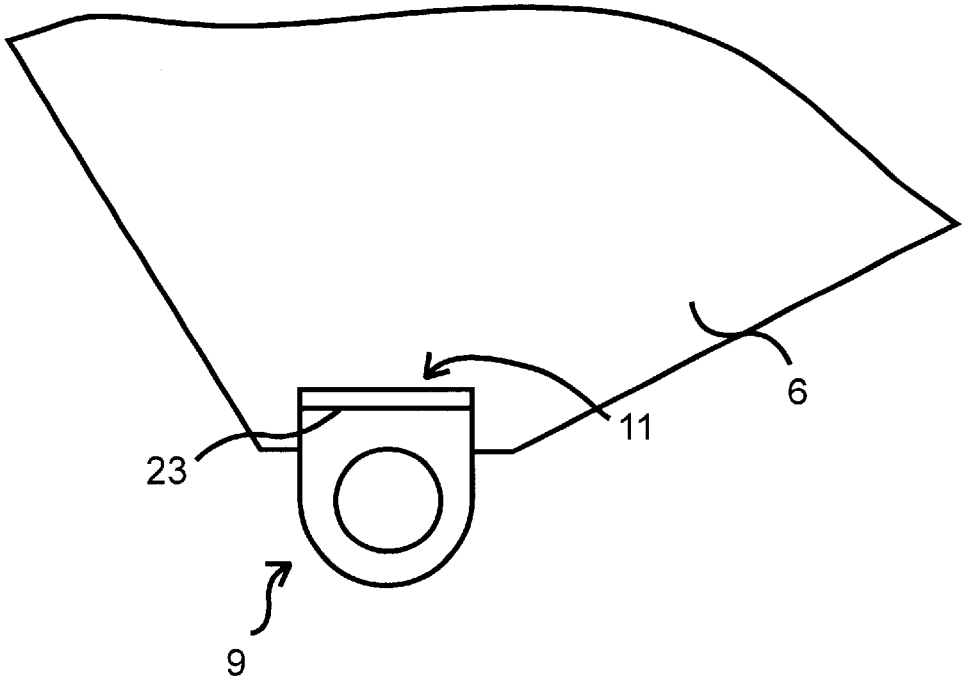

FIG. 6 shows the groove 11 without an undercut. The expansion element is bonded to the bottom of the groove by means of adhesive 23 and is consequently held frictionally. Instead of a flat bottom, it would obviously also be possible to have a pitch circular bottom. There can also be a combination of the fixing procedures of FIGS. 3 to 5 on the one hand (form-closure) and FIG. 6 on the other (frictional).

What is claimed is:

1. Apparatus for forming blanks, comprising:

a forming die having a blank receiving cavity including edge and corner regions, and a forming insert for insertion into the cavity, said insert having corresponding edge and corner regions including recessed expansion spaces.

2. Apparatus according to claim 1, additionally comprising closed expansion elements placed in said expansion spaces.

3. Apparatus according to claim 2, wherein the expansion elements extend according to spatial extension directions of the recessed expansion spaces.

4. Apparatus according to claim 3, wherein the expansion elements are frictionally engaged in the recessed expansion spaces.

5. Apparatus according to claim 3, wherein undercuts are provided in said edge regions of the forming insert and wherein the expansion elements are held by said undercuts.

6. Apparatus according to claim 3, wherein grooves having undercuts are provided in said edge regions of the forming insert and wherein the expansion elements are fixed in said grooves.

7. Apparatus according to claim 3, wherein the expansion elements are held by holding plates partly covering the same, and fixed to the forming insert.

8. Apparatus according to claim 2, wherein the expansion elements are in the form of expandable tubes.

9. Apparatus according to claim 8, wherein the expansion elements are made from a highly loadable, flexible polymer material.

10. Apparatus according to claim 8, wherein the expansion elements are made from deformable metal.

11. Apparatus according to claim 8, additionally comprising high liquid pressure means, connected to the tubes to apply high liquid pressure in the expansion spaces.

12. Apparatus according to claim 1, additionally comprising high liquid pressure means, for subjecting only the expansion spaces to high liquid pressure.

13. A method for forming blanks, comprising:

a) providing a forming die having a blank receiving cavity including edge and corner regions;

b) inserting a blank into said cavity, the blank being preformed to generally the shape of the cavity;

c) inserting into the cavity a forming insert, said insert having corresponding edge and corner regions including recessed expansion spaces; and, d) subjecting only the expansion spaces to high pressure liquid pressure, whereby the blank is shaped to more closely follow the edge and corner portions of the cavity.

14. A method according to claim 13, wherein closed expansion elements are provided in the expansion spaces to engage on areas of the blank to be shaped, and wherein the expansion elements are subjected to high pressure liquid pressure.

15. A method according to claim 14, wherein the expansion elements are in the form of expandable tubes, and wherein the tubes are connected to the high pressure liquid pressure.

* * * * *